United States Patent [19]

Dürr

[11] Patent Number: 4,514,833

[45] Date of Patent: Apr. 30, 1985

[54] DISPERSING MACHINE WITH CONTAINER HOLDING DEVICE

[75] Inventor: Herbert Dürr, Viernheim, Fed. Rep. of Germany

[73] Assignee: Draiswerke GmbH, Mannheim, Fed. Rep. of Germany

[21] Appl. No.: 419,488

[22] Filed: Sep. 17, 1982

[30] Foreign Application Priority Data

Sep. 26, 1981 [DE] Fed. Rep. of Germany ..... 3138382

[51] Int. Cl.[3] ..... B01F 7/16

[52] U.S. Cl. ..... 366/207; 366/286; 294/86.4

[58] Field of Search ..... 366/286, 209, 197, 201, 366/207, 211, 605, 261, 331; 24/263 A, 263 DA, 263 DB, 243 B; 248/316 A, 122, 149, 154; 294/67 BB, 86 R

[56] References Cited

U.S. PATENT DOCUMENTS

| | | | |
|---|---|---|---|
| 1,005,653 | 10/1911 | Osius | 366/207 X |
| 1,313,830 | 8/1919 | Minsk | 366/286 |
| 1,733,945 | 10/1929 | Dehuff | 366/207 |
| 2,550,019 | 4/1951 | Murphy | 248/154 |
| 2,599,833 | 6/1952 | Holmlund | 366/605 X |
| 2,698,764 | 1/1955 | Holland | 294/67 BB |
| 2,894,309 | 7/1959 | Brzowski | 366/211 X |
| 2,959,445 | 11/1960 | Breslav | 294/67 BB |
| 3,002,779 | 10/1961 | Frate et al. | 294/67 BB |
| 3,207,488 | 9/1965 | Brasington | 366/197 |
| 4,042,221 | 8/1977 | Myers et al. | 366/207 X |
| 4,190,371 | 2/1980 | Durr et al. | 366/139 |
| 4,261,609 | 4/1981 | Kraszewski et al. | 294/119.1 X |
| 4,415,270 | 11/1983 | Heinis | 366/605 X |

FOREIGN PATENT DOCUMENTS

| | | | |
|---|---|---|---|
| 1094663 | 5/1955 | France | 294/103 R |
| 47909 | 9/1979 | Japan | 294/67 BB |
| 5984 | of 1893 | United Kingdom | 366/197 |
| 317605 | 1/1972 | U.S.S.R. | 294/67 BB |

*Primary Examiner*—Philip R. Coe
*Assistant Examiner*—Frankie L. Stinson
*Attorney, Agent, or Firm*—Browdy and Neimark

[57] ABSTRACT

A dispersing machine having a machine upright has a cantilevered machine head disposed thereon such that it can be raised and lowered by means of a lifting apparatus which can be acted upon by a pressure-medium pumping assembly. A rotatably drivable stirring apparatus is disposed on one cantilevered end of the machine head and is lowered into a container disposed beside the machine upright and connected with it in a releasable manner by means of a container holding device. The container holding device has at least two clamping members substantially receiving the container between them. In order to make it easier to initiate and release the clamping action exerted on the container, the container holding device is actuated by means of a pressure-medium motor, which is connected with the pressure-medium pumping assembly.

3 Claims, 4 Drawing Figures

DISPERSING MACHINE WITH CONTAINER HOLDING DEVICE

FIELD OF THE INVENTION

The invention relates to a dispersing machine which has a cantilevered head disposed on a machine upright. The head can be raised and lowered by a lifting apparatus acted upon by a pressure-medium pumping assembly, and a stirring apparatus which can be rotatably driven is disposed on one cantilevered end of the head. The stirring apparatus is lowered into a container disposed beside the machine and connected releasably with the container by means of a container holding device, which has at least two clamping members substantially receiving the container between them. At least one of the clamping members is provided with a spindle nut disposed on a rotatable spindle.

BACKGROUND OF THE INVENTION

In dispersing machines of this general type, it is necessary to connect the container receiving the product to be processed in a firm but releasable manner with the machine by means of a container holding device if the container itself does not have a fixed place on a machine base or the like but is instead movable by means of rollers. Known container holding devices of this kind have a guide rail disposed on the machine upright, on which tong members are disposed such that they are displaceable parallel to one another. This displacement is effected by means of a spindle disposed parallel to the guide rail and having threaded sections with threads running in opposite directions. On each of these spindle sections there is a threaded nut, which is tightly connected in turn with the corresponding tong member. A hand crank by means of which the clamping action can be initiated or released is disposed on the spindle. The tong members tend to remain in the clamping position because of the self-locking action of the spindle. Initiating and releasing the clamping action is tedious.

SUMMARY OF THE INVENTION

It is accordingly a principal object of the invention to provide a dispersing machine of the general type just described such that initiating and releasing the clamping of the container is made easier.

In accordance with the invention, this object is attained in a dispersing machine as generally described above by coupling the spindle with a pressure-medium motor embodied as a rotatable motor connected to the pressure-medium pumping assembly. Although dispersing machines of the general types described above have long been known, and although the problem addressed above has existed for a long time, a successful solution had not heretofore been attained. By means of the provisions of the present invention, the pressure-medium pumping assembly which is already present in the machine is additionally used for actuating the container holding device. The pressure-medium pumping assembly does not have to be enlarged or reinforced in order to perform this additional function, because reciprocating movements of the machine head on the one hand and actuations of the container holding devices on the other take place at different times in the course of operation of a dispersing machine of this type. Thus what has been attained are astonishingly simple solutions to the problem addressed by the present invention.

Further advantageous embodiments of the present invention are attained by providing spindle nuts embodied for displacement of the clamping members in opposite directions from one another and by embodying the clamping members as tong members which can be pressed against the outer wall of the container. Alternatively, tension rods, tension chains or the like may also serve as clamping members.

Further advantages and characteristics of the present invention will become apparent from the ensuing description of one exemplary embodiment, taken in conjunction with the drawings.

DESCRIPTION OF THE PREFERRED EMBODIMENT

Figure 1:
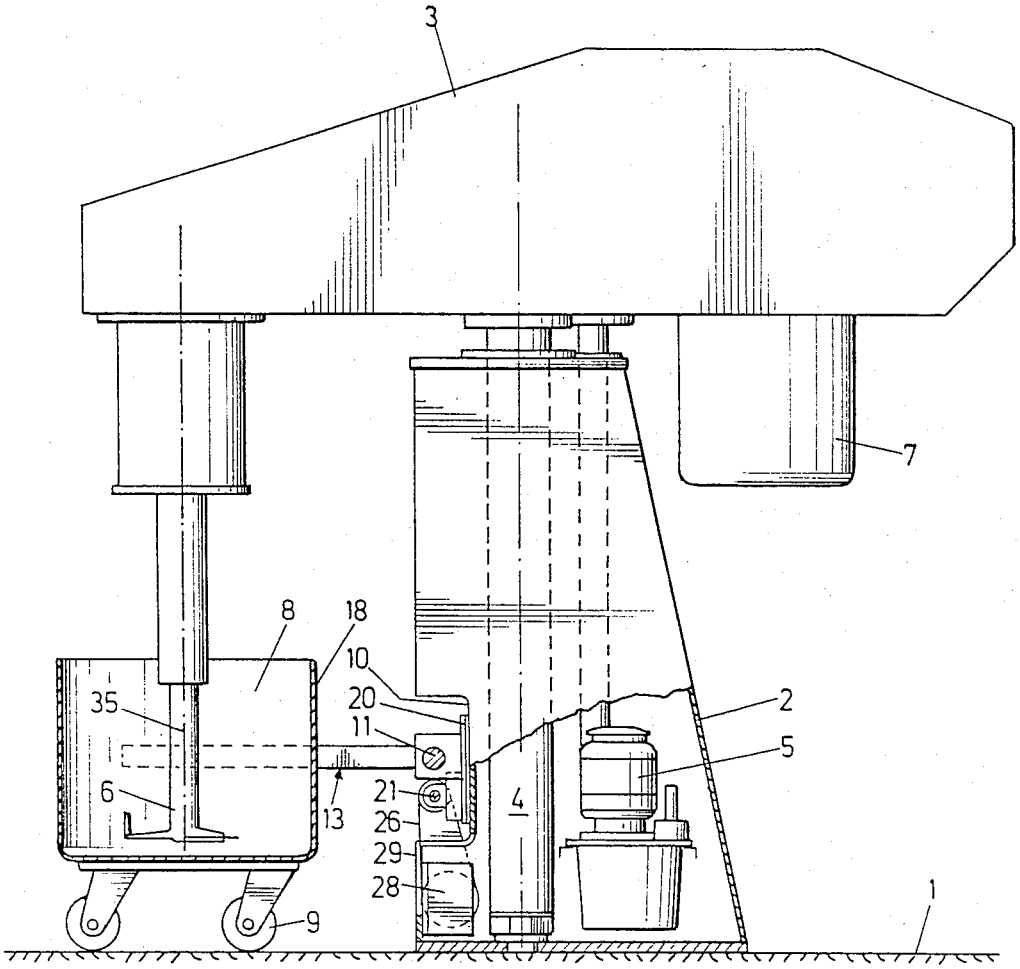
FIG. 1 is a view in elevation, partially in section, and partially broken away, showing the basic structure of a dispersing machine in accordance with the invention.

A dispersing machine such as that shown in FIG. 1 has a machine upright or vertical column 2, as a rule supported on a base 1, on which a machine head 3 cantilevered or overhanging at one end or at both ends is disposed so that it can be raised and lowered. A lifting apparatus 4 which can be operated hydraulically and thus comprises a piston-cylinder drive mechanism is disposed in the machine upright 2 for raising and lowering the machine head. For supplying this lifting apparatus 4 with pressure fluid, a hydraulic pumping assembly 5 is provided in the machine upright 2.

On one cantilevered end of the machine head 3, there is a stirring apparatus 6 protruding vertically downwardly therefrom. The stirring apparatus 6 is drivable by a drive motor 7 disposed on the opposite side of the machine head 3. The stirring apparatus may be embodied, by way of example, as shown and described in German laid-open applications DE-OS No. 26 27 600 (U.S. Pat. No. 4,190,371) and DE-OS No. 27 57 486 (U.S. Pat. No. 4,107,792).

The stirring apparatus 6 protrudes into a container 8, which is movable on rollers 9. This container 8 serves to receive the material which is to be dispersed, suspended, emulsified, dissolved, aerated, evacuated and/or homogenized. In order that this movable container 8 remains at a standstill at its assigned place concentric with the stirring apparatus 6 during the above-described processing of the material located in the container, a container holding device is provided.

Figure 2:
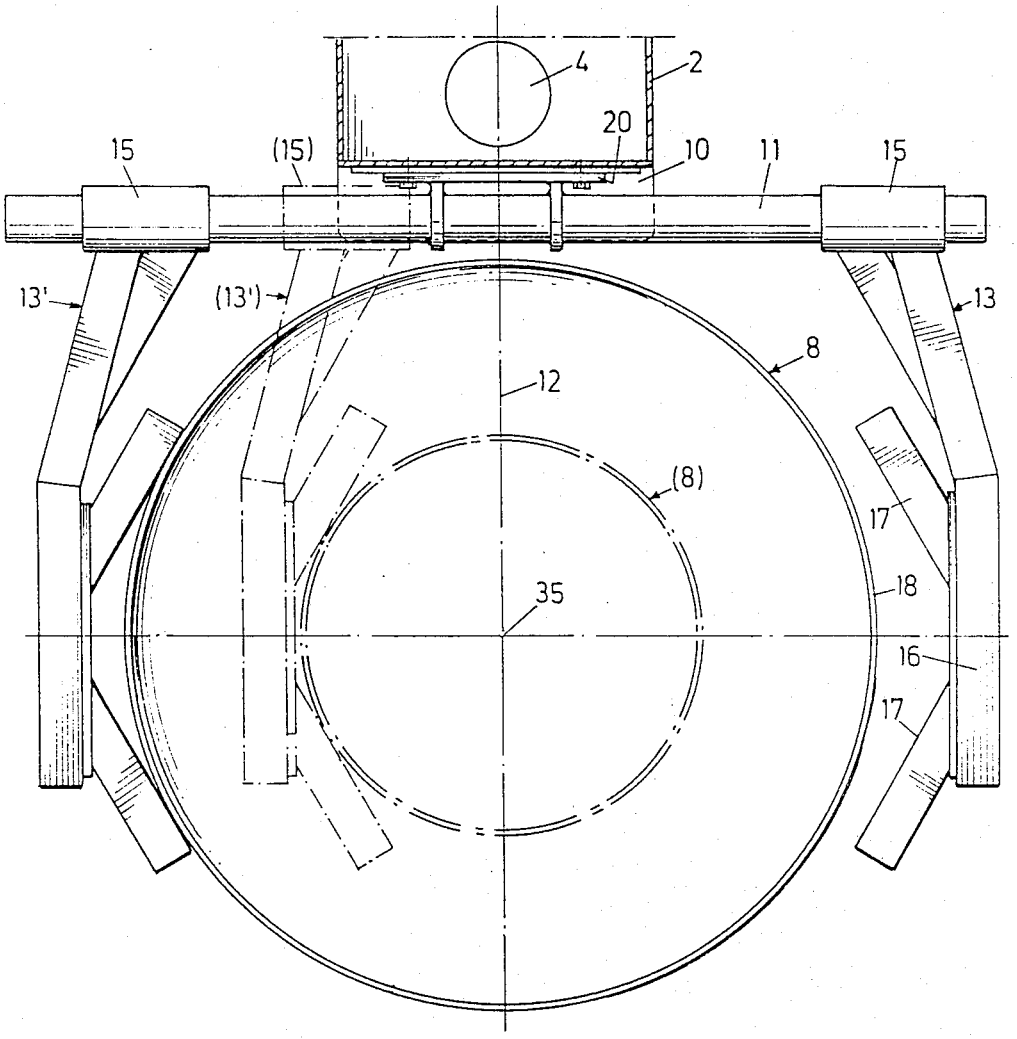
FIG. 2 is a plan view of one embodiment of a container clamping device in accordance with the invention.
Figure 3:
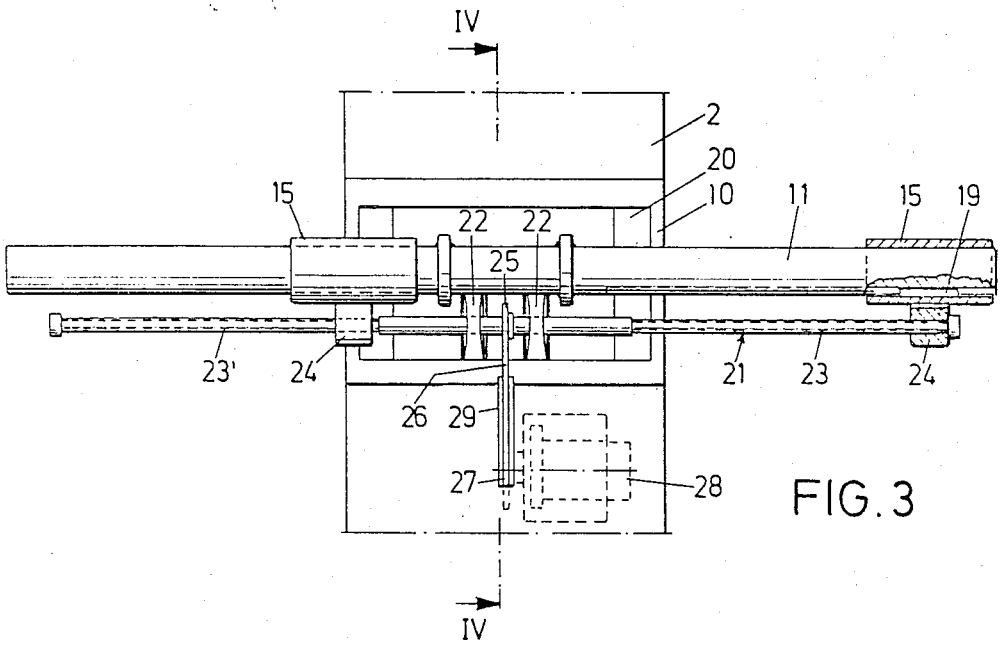
FIG. 3 shows the container clamping device of FIG. 2 in a front view, partially cut away.
Figure 4:
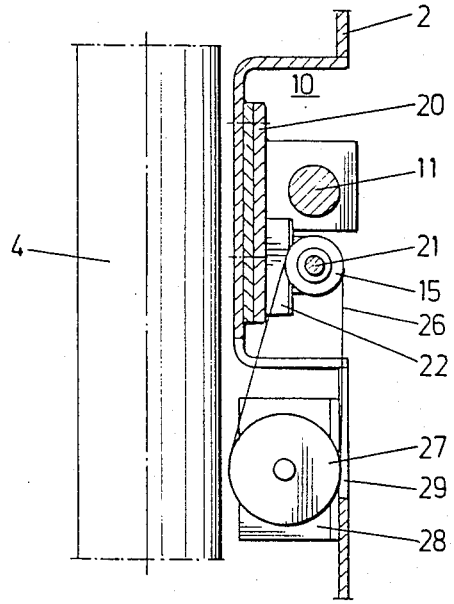
FIG. 4 is a sectional view taken along the line IV—IV of FIG. 3.

In the form of embodiment shown, a guide rail 11 made of round stock is disposed in a recess 10 in the machine upright 2 oriented toward the container 8; the guide rail is disposed perpendicular to the vertical primary plane of symmetry 12 of the dispersing machine. Two tong members 13, 13' are disposed on this guide rail extending horizontally and at a tangent to the container 8 in mirror symmetry to one another. They are each disposed such that they are displaceable by means of corresponding guide bushings 15 movable along the guide rail 11; one tong arm 16 is disposed on each guide bushing 15, and tong jaws 17 are disposed in turn on each tong arm 16. The tong jaws 17 rest at a tangent against the outer wall 18 of the container 8, and as shown in FIG. 2, containers 8 of quite variable diameters can be received between two tong members 13, 13'. In order to be able to displace the tong members 13, 13' in the horizontal plane on the guide rail 11, a tongue-in-groove joint 19 is provided between each guide bushing 15 and the guide rail 11, preventing the guide bushing 15 and the guide rail 11 from rotating relative to one another but permitting them to be axially displaced relative to one another. The guide rail 11 is connected at its center to a bearing block 20 in a rotationally fixed manner by means of welding; the bearing block, in turn, is screwed in the recess 10 onto the machine upright 2.

Parallel to the guide rail 11 and below it, a spindle 21 is rotatably supported in two bearings 22 in the bearing block 20. The spindle 21 has threaded sections 23 and 23' extending over the entire displacement path of the tong members 13, 13' and with threads running in opposite directions. A spindel nut 24 provided with a corresponding thread is attached to each threaded section 23 and 23', respectively, each nut 24 being firmly connected with an associated guide bushing 15.

At the center, between the two bearings 22, a sprocket wheel 25 is secured in a rotationally fixed manner on the spindel 21, and a chain 26 is guided around the sprocket wheel and about a pinion 27 of a hydraulic motor 28 embodied as a rotary motor. This hydraulic motor 28 is disposed directly below the recess 10 in the machine upright 2. An appropriate cut 29 is provided in the machine upright 2 for freedom of guidance of the chain 26. The supply of pressure fluid to the hydraulic motor 28 is effected via lines (not shown) from the hydraulic pumping assembly 5.

In this embodiment, the tong members 13, 13' are displaceable parallel to themselves.

It is not necessary to block the hydraulic motor 28 by means of the hydraulic fluid in order to maintain the clamping position, because the spindle 21 is embodied as a self-locking spindle in the conventional manner.

Naturally, a pneumatic supply means can be provided instead of a hydraulic supply means, so that in that case the lifting apparatus 4 and the motor 28 are embodied as a pneumatic drive mechanism. The assembly 5 is then embodied accordingly as a pneumatic pumping assembly.

Instead of the tong-like embodiment, tension chains or tension rods may also be provided, by means of which the container is pulled toward or pressed against corresponding systems connected with the machine upright 2.

It is to be understood that the foregoing text and drawings relate to an embodiment of the invention given by way of example but not limitation. Various other embodiments and variants are possible within the scope of the invention.

What is claimed is:

1. A dispersing machine having a machine upright and a cantilevered machine head mounted on said upright for raising and lowering movement by means of a lifting apparatus acted upon by a pressure medium pumping assembly, a rotatably drivable stirring apparatus having a portion mounted in one cantilevered end of said machine head, said stirring apparatus being drivable by means of a drive motor mounted on the dispersing machine and being movable vertically downwardly into a container disposed beside the machine upright, a container holding device mounted on said upright for releasably connecting said container to said upright, said container holding device having at least two clamping members substantially receiving the container therebetween concentrically with said strirring apparatus during processing of material contained therein, at least one of said clamping members being provided with a spindle nut disposed on a rotatably drivable spindle, said spindle being disposed horizontally and coupling said clamping members with a rotatable motor driven by a pressure medium, and means, fluidly connecting said rotatable motor to said pressure medium pumping assembly, for rotatably driving said rotatable motor, and thus rotatably driving said spindle, to cause movement of said at least one clamping member relative to the other of said clamping members.

2. A dispersing machine as defined by claim 1, characterized in that said spindle has two threaded sections with threads running in opposite directions, a corresponding spindle nut threadedly mounted on each of said threaded sections, each of said spindle nuts being connected to a corresponding clamping member, whereby movement of the respective spindle nuts causes the corresponding clamping members to be moved into or out of clamping engagement with the container.

3. A dispersing machine as defined in claims 1 or 2, characterized in that the clamping members are embodied as tong members which may be pressed against the outer wall of the container.

* * * * *